US010673159B2

(12) United States Patent
Ishida

(10) Patent No.: US 10,673,159 B2
(45) Date of Patent: Jun. 2, 2020

(54) GROUNDED ELECTRICAL CONNECTOR

(71) Applicant: SMK Corporation, Tokyo (JP)

(72) Inventor: Yoshiyasu Ishida, Saitama (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 16/507,047

(22) Filed: Jul. 10, 2019

(65) Prior Publication Data

US 2020/0044374 A1 Feb. 6, 2020

(30) Foreign Application Priority Data

Aug. 3, 2018 (JP) ..... 2018-146723

(51) Int. Cl.
*H01R 12/72* (2011.01)

(52) U.S. Cl.
CPC ..... *H01R 12/721* (2013.01)

(58) Field of Classification Search
CPC .. H01R 12/7029; H01R 12/716; H01R 12/16; H01R 12/17; H01R 12/18; H01R 12/71; H01R 12/721
See application file for complete search history.

(56) References Cited

U.S. PATENT DOCUMENTS 5,545,051 A * 8/1996 Summers ..... H01R 12/716 439/350
5,626,482 A * 5/1997 Chan ..... H01R 12/716 439/74
6,116,949 A * 9/2000 Costello ..... H01R 13/6485 439/509
6,250,935 B1 * 6/2001 Mochizuki ..... H01R 13/658 439/74
6,855,004 B2 * 2/2005 Soh ..... H01L 23/60 439/41
6,955,546 B1 * 10/2005 Huang ..... H01R 13/5213 439/135
7,074,085 B2 * 7/2006 Chen ..... H01R 13/658 439/607.36
7,232,317 B2 * 6/2007 Ookura ..... H01R 13/506 439/660
7,367,816 B2 * 5/2008 Liu ..... H01R 13/26 439/74
7,748,994 B1 * 7/2010 Peng ..... H01R 12/716 439/660

(Continued)

FOREIGN PATENT DOCUMENTS

JP 2017103119 A 6/2017

*Primary Examiner* — Abdullah A Riyami
*Assistant Examiner* — Nader J Alhawamdeh

(57) ABSTRACT

An electric connector includes connector bodies in which connection terminal trains are arranged in a coplanar fashion in male and female connector housings; and a ground connection fitting that is equipped therein so as to extend between the connection terminal trains in a train direction. At least one connector body has a conductive reinforcement fitting that extends along the connector housing. The ground connection fitting has ground connection portions that are exposed to the side of a board facing surface of the corresponding connector housing of the connector body; and reinforcement fitting connection portions that are connected to the reinforcement fitting on both outsides of the connection terminal trains in the train direction.

8 Claims, 14 Drawing Sheets

(56) References Cited

U.S. PATENT DOCUMENTS

| | | | | |
|---|---|---|---|---|
| 7,922,499 | B2 * | 4/2011 | Liao | H01R 12/714 439/660 |
| 8,272,881 | B2 * | 9/2012 | Miyazaki | H01R 12/716 439/345 |
| 8,292,635 | B2 * | 10/2012 | Little | H01R 12/7029 439/570 |
| 8,992,233 | B2 * | 3/2015 | Miyazaki | H01R 12/707 439/74 |
| 10,396,479 | B2 * | 8/2019 | Hoshiba | H01R 13/646 |
| 2004/0018756 | A1 * | 1/2004 | Pan | H01R 13/6271 439/74 |
| 2010/0130068 | A1 * | 5/2010 | Peng | H01R 13/2457 439/660 |
| 2010/0190383 | A1 * | 7/2010 | Yamada | H01R 13/6315 439/680 |
| 2011/0165797 | A1 * | 7/2011 | Takeuchi | H01R 12/716 439/660 |
| 2011/0250800 | A1 * | 10/2011 | Guo | H01R 12/716 439/660 |
| 2013/0012074 | A1 * | 1/2013 | Mashiyama | H01R 12/73 439/660 |
| 2013/0023162 | A1 * | 1/2013 | Harlan | H01R 12/73 439/660 |
| 2013/0280926 | A1 * | 10/2013 | Ono | H01R 12/712 439/65 |
| 2014/0227910 | A1 * | 8/2014 | Tanaka | H01R 12/7052 439/626 |
| 2015/0207248 | A1 * | 7/2015 | Takenaga | H01R 12/716 439/74 |
| 2020/0044374 | A1 * | 2/2020 | Ishida | H01R 12/721 |

* cited by examiner

GROUNDED ELECTRICAL CONNECTOR

CROSS REFERENCE TO RELATED APPLICATION

The contents of the following Japanese patent application are incorporated herein by reference, Japanese Patent Application No. 2018-146723 filed on Aug. 3, 2018.

FIELD

The present invention relates to an electric connector, and more specifically relates to an electric connector having a socket mounted on a circuit board and a plug that is concave-convex engaged with the socket.

BACKGROUND

Plate-shaped electric connectors mounted on boards are conventionally used as connectors to connect flexible circuit boards to the circuit boards, or the like.

As this type of electric connectors, for example, there is known a connector in which contact trains (a plurality of connection terminals) are provided in an opposite manner in each of a socket to be mounted on a circuit board and a plug concave-convex engaged therewith, on both sides in respective lateral directions. The socket includes a middle ground connection fitting that extends between the contact trains in train directions (longitudinal direction of the socket), and end connection members provided on both ends for continuity between the middle ground connection fitting and the circuit board. The plug includes a board connection member that can be engaged with both the end connection members of the socket to come into contact therewith from the lateral direction, and can be connected to a ground portion of the flexible circuit board (for example, see Patent Literature 1).

CITATION LIST

Patent Literature

Patent Literature 1: Japanese Patent Application Laid-Open No. 2017-103119

SUMMARY

Technical Problem

However, the above-described conventional electric connector has a problem that the effect of ground shielding using the middle ground connection fitting and both the end connection members of the socket is just limited to a shielding effect between the contact trains on both sides in the lateral direction of the connector.

Since the middle ground connection fitting is butt-joined to, and comes into contact with, inner end portions of the substantially T-shaped end connection members at its both ends in the longitudinal direction, to establish connection with the circuit board through both the end connection members, there are a problem of increasing the size of the connector, and a problem of disabling stable connection between the middle ground connection fitting and the ground portion of the circuit board.

Accordingly, an object of the present invention is to provide an electric connector that enables stable connection between a ground portion of a circuit board and a ground connection fitting provided between terminal trains, and can improve the effect of ground shielding using the ground connection fitting without an increase in the size of the connector.

Solution to Problem

To achieve the above-described object, an electric connector according to an aspect of the present invention includes first and second connector bodies in which a plurality of connection terminal trains are arranged in a coplanar fashion in first and second connector housings that can be concave-convex joined in opposite directions; and a ground connection fitting that is equipped in one connector body of the first and second connector bodies so as to extend between the connection terminal trains in a direction of the connection terminal trains. At least the one connector body has a conductive reinforcement fitting that extends along the corresponding connector housing. The ground connection fitting has a ground connection portion that is exposed to the side of a board facing surface of the corresponding connector housing of the one connector body; and reinforcement fitting connection portions that are connected to the reinforcement fitting on both outsides of the connection terminal trains in the direction of the connection terminal trains.

According to this structure of the aspect of the present invention, the ground connection portion of the ground connection fitting can be easily connected to a ground on the side of the ground facing surface of the connector housing, and the reinforcement fitting connection portions of the ground connection fitting are connected to the reinforcement fitting on the outsides of the connection terminal trains in the direction of the connection terminal trains. Therefore, it is possible to improve a ground shielding effect using the ground connection fitting without an increase in the size of the connector.

In the electric connector according to an aspect of the present invention, the reinforcement fitting connection portion of the ground connection fitting is mechanically and electrically joined to the reinforcement fitting that extends along the corresponding connector housing of the one connector body.

According to the structure, the reinforcement fitting situated around the connection terminal trains of the one connector body is ground shielded through the ground connection fitting, and the reinforcement fitting and the ground connection fitting, which are mechanically joined, are held integrally with the connector body.

The reinforcement fitting may include a first reinforcement fitting formed of a conductive plate member extending along the first connector housing, and a second reinforcement fitting formed of another conductive plate member extending along the second connector housing. The first and second reinforcement fittings may have local press contact surfaces that come into press contact with each other.

In this case, an operation feeling such as a click feeling between the male and female connection terminal trains at the time of connecting the connector is improved by a change of an operation force required of concave-convex engagement between the first and second reinforcement fittings. Since the male and female connection terminal trains are in contact with each other in a stable connection position and with a stable contact pressure, it is possible to reliably ensure a required connector connection state.

In the electric connector according to an aspect of the present invention, the reinforcement fitting may include a first reinforcement fitting formed of a conductive plate member extending along the first connector housing, and a second reinforcement fitting formed of a conductive plate member extending along the second connector housing. The ground connection fitting may have a first reinforcement fitting connection portion connected to the first reinforcement fitting, and a second reinforcement fitting connection portion that is retained and engaged with the second reinforcement fitting.

In this case, while an operation feeling such as a click feeling between the male and female connection terminal trains at the time of connecting the connector can be improved by a change of an operation force required of the retained engagement between the ground connection fitting and the second reinforcement fitting, a stable connector connection state can be ensured.

In the electric connector according to an aspect of the present invention, the reinforcement fitting connection portion of the ground connection fitting may be mechanically and electrically joined to the reinforcement fitting extending along the corresponding connector housing, and may be contained in an opening of the reinforcement fitting.

This increases the degree of flexibility in the arrangement of the connection position between the reinforcement fitting and the reinforcement fitting connection portion of the ground connection fitting, while restraining space for arrangement thereof by sharing the opening of the reinforcement fitting.

The reinforcement fitting connection portion of the ground connection fitting may be mechanically and electrically joined to one reinforcement fitting extending along the corresponding connector housing of the one connector body, and may come into engagement contact with the other reinforcement fitting extending along the corresponding connector housing of the other connector body of the first and second connector bodies.

The reinforcement fitting connection portion of the ground connection fitting may have a retaining holder at a predetermined joint depth position in the direction of the concave-convex joint of the first and second connector housings, to make concave-convex engagement with the other reinforcement fitting in a longitudinal direction of the connector housing.

In this case, an operation feeling such as a click feeling between the male and female connection terminal trains at the time of connecting the connector is improved by a change of an operation force required of the concave-convex engagement between the first and second reinforcement fittings. Since the male and female connection terminal trains are in contact with each other in a stable connection position and with a stable contact pressure, it is possible to reliably ensure a required connector connection state.

Furthermore, the first and second reinforcement fittings may have additional engagement holders outside the connection terminal trains in the direction of the connection terminal trains and at the predetermined joint depth position, to come into press contact with each other in a direction orthogonal to the direction of the connection terminal trains.

In this case, since the concave-convex engagement directions of the first and second reinforcement fittings are the same as the engagement directions of the male and female connection terminal trains, and the concave-convex engagement portions of both the reinforcement fittings are situated outside the connection terminal trains in the longitudinal directions of the connector housings, it is possible to stabilize the engagement postures of the connection terminal trains.

According to the aspects of the present invention, it is possible to provide an electric connector that can stably connect a ground connection fitting provided between terminal trains to a ground portion of a circuit board, and can improve the effect of ground shielding using the ground connection fitting, without an increase in the size of the connector.

DESCRIPTION OF EMBODIMENTS

Figure 1:
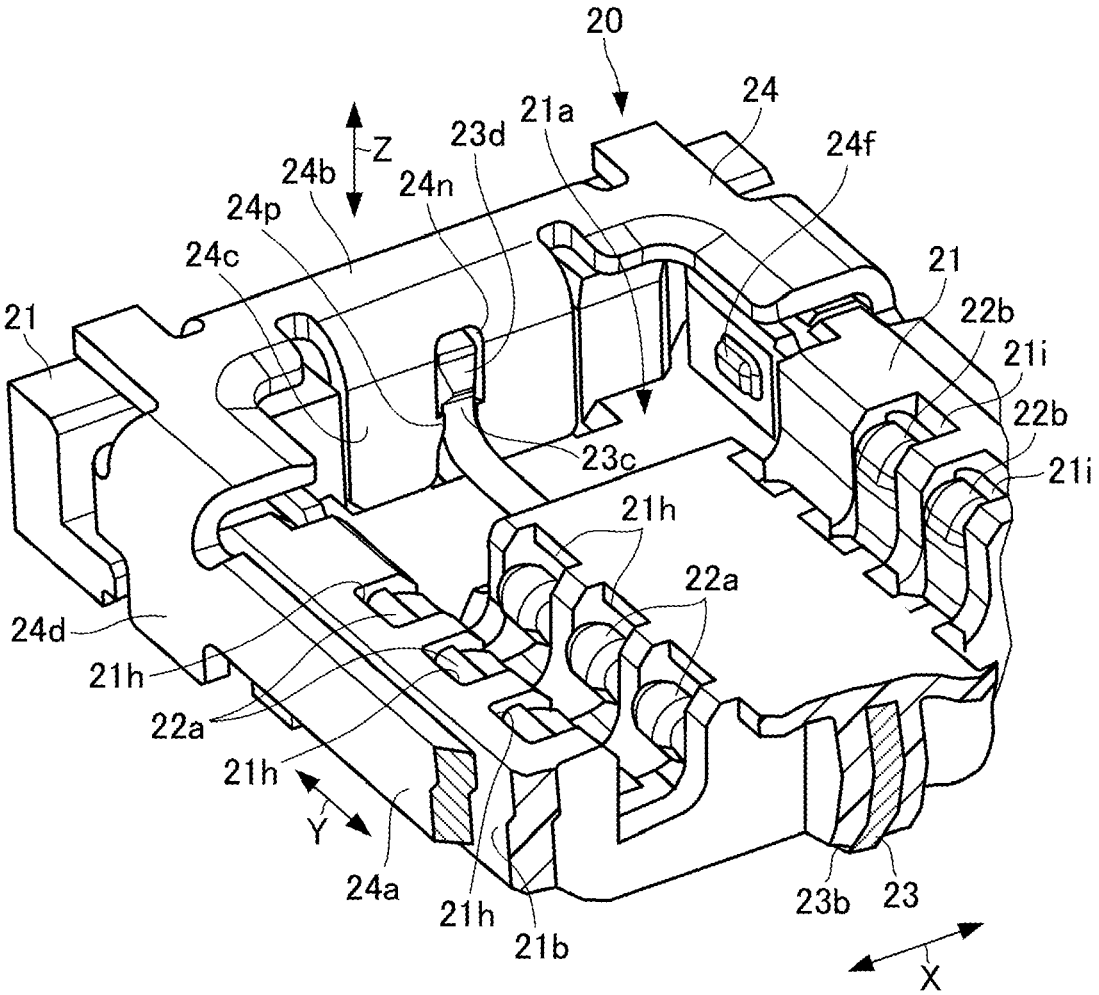
FIG. 1 is a perspective view of a portion of a socket of an electric connector according to a first embodiment of the present invention, including a partly broken section.
Figure 2:
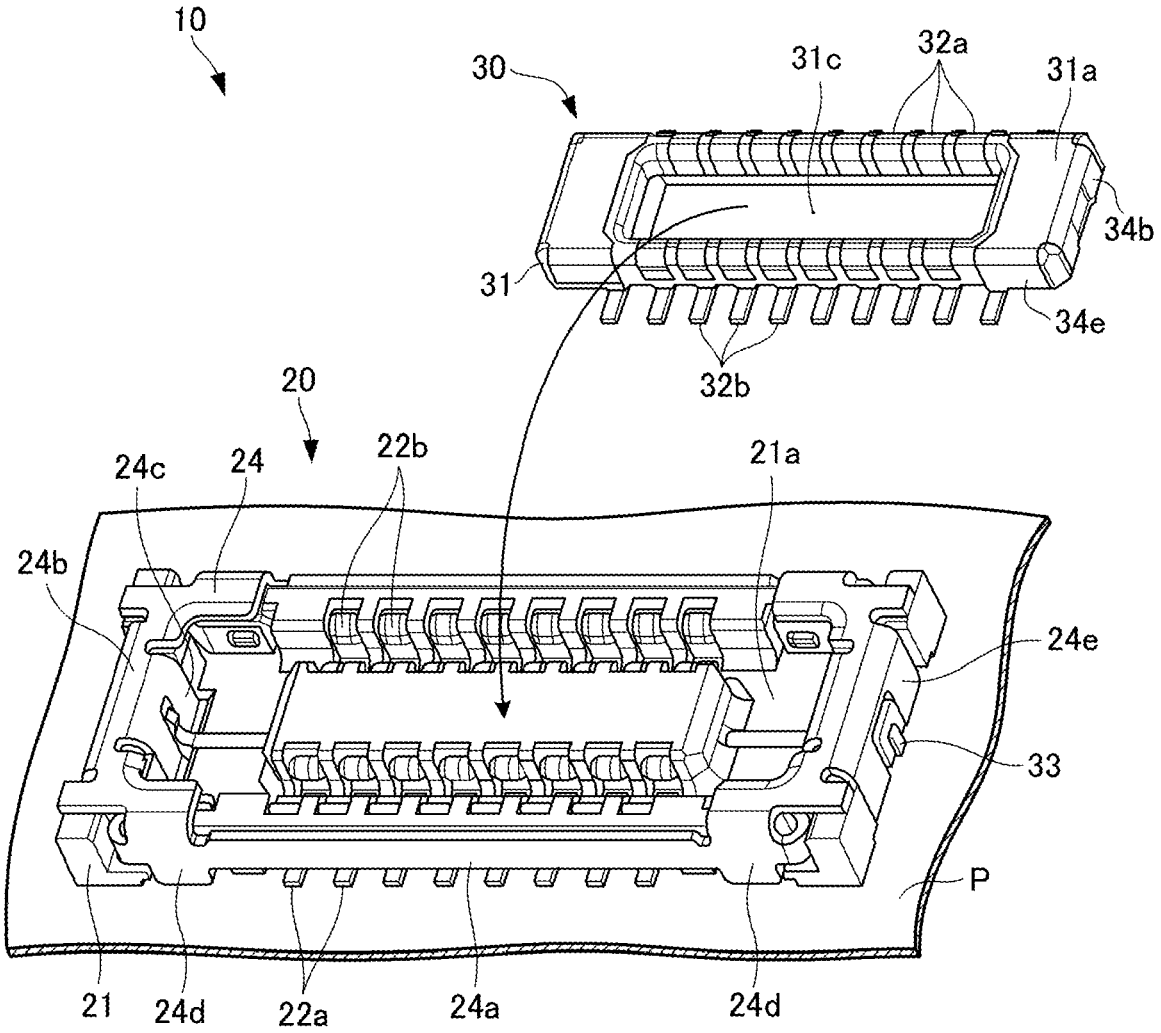
FIG. 2 is an exploded perspective view of the electric connector according to the first embodiment of the present invention.
Figure 3A:
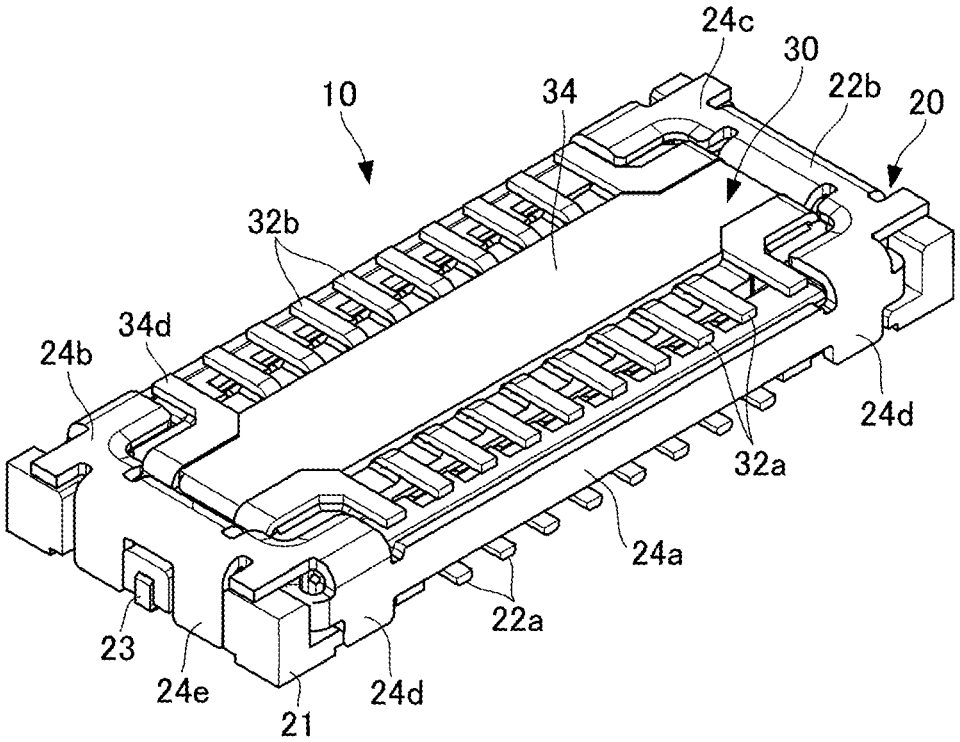
FIG. 3A is an perspective view of the side of a top surface of the electric connector according to the first embodiment of the present invention in a male and female joining state between a socket and a plug.
Figure 3B:
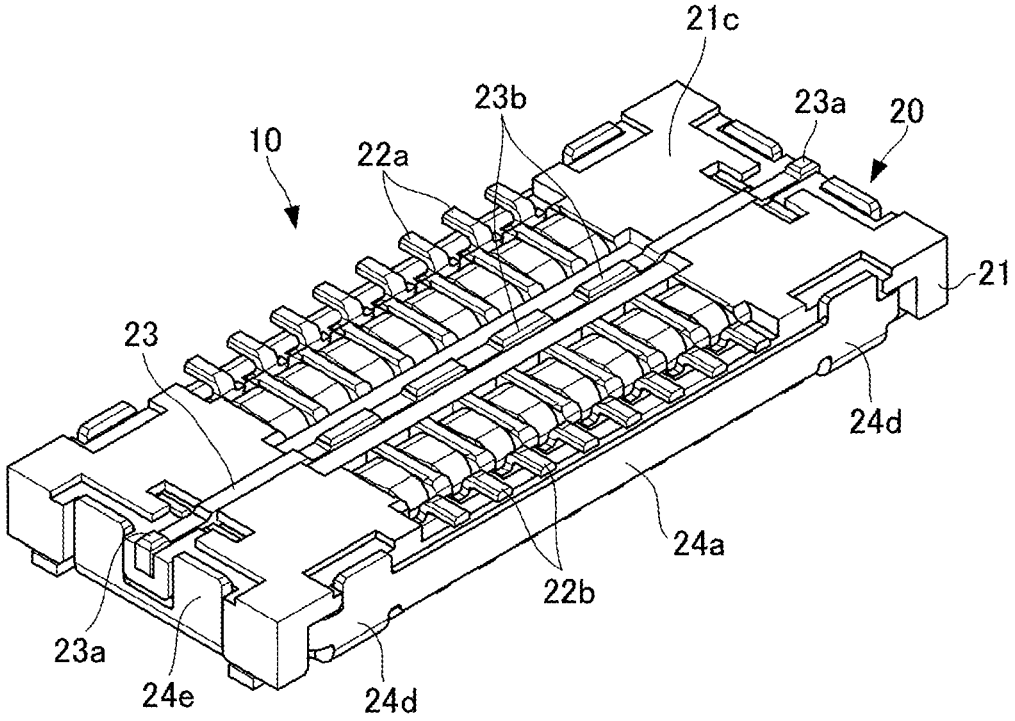
FIG. 3B is an perspective view of the side of a bottom surface of the electric connector according to the first embodiment of the present invention in a male and female joining state between a socket and a plug.
Figure 4A:
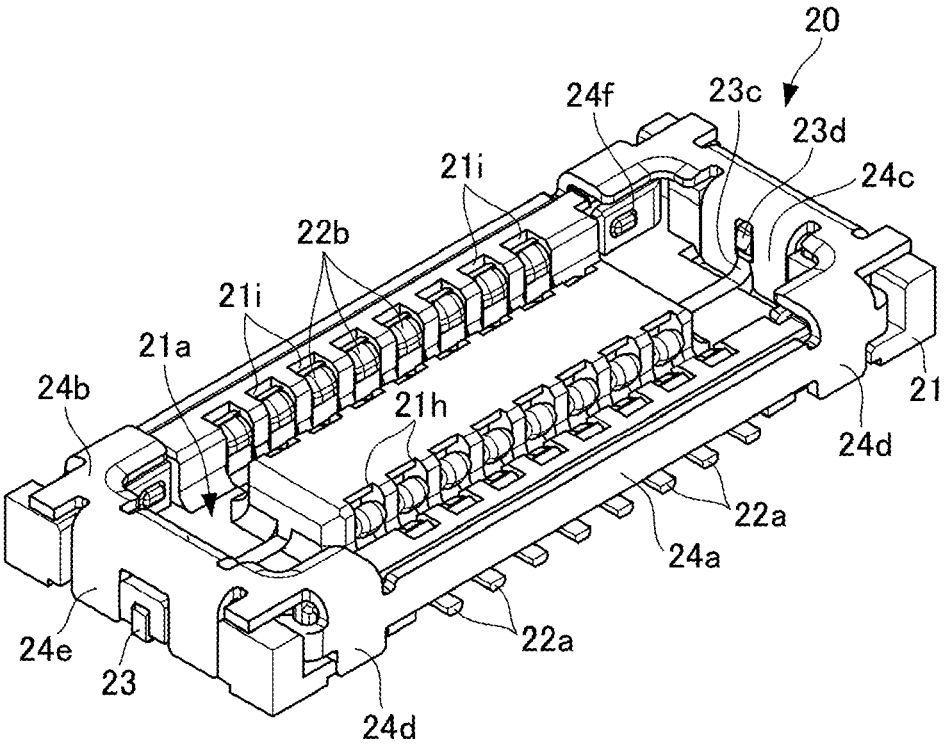
FIG. 4A is an exterior perspective view of the side of a top surface of the socket of the electric connector according to the first embodiment of the present invention.
Figure 4B:
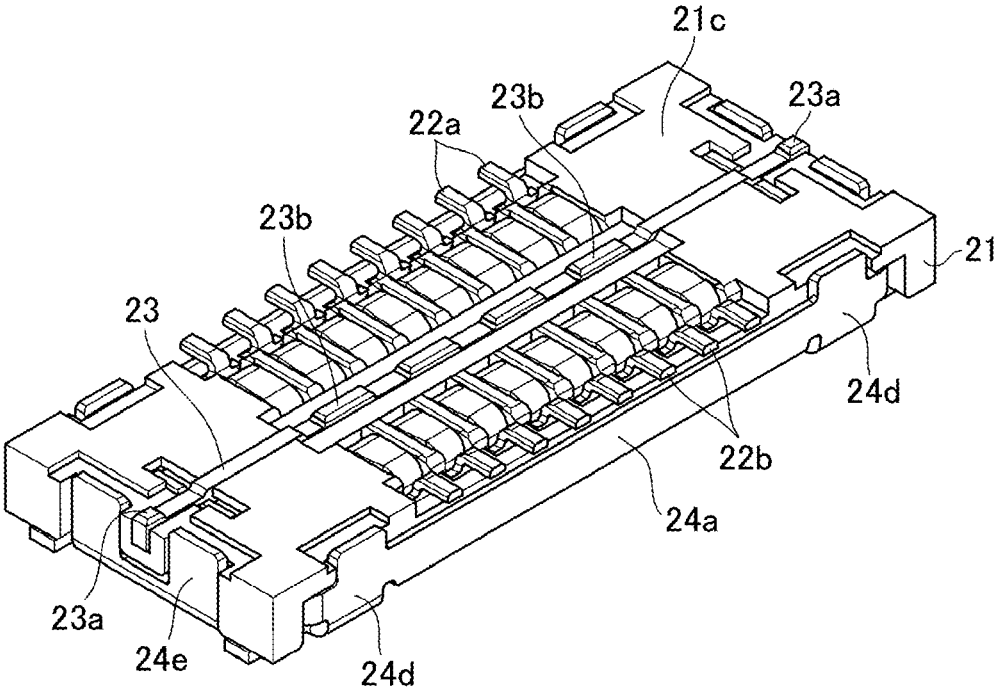
FIG. 4B is an exterior perspective view of the side of a bottom surface of the socket of the electric connector according to the first embodiment of the present invention.

Embodiments of the present invention will be described below with reference to the drawings.

First Embodiment

FIGS. 1 to 7C illustrate an electric connector according to a first embodiment of the present invention.

The structure will be first described.

As illustrated in FIGS. 1 to 3B, an electric connector 10 according to the present embodiment is substantially in the shape of a plate having a so-called pseudo-coaxial structure. The electric connector 10 is configured to include a socket-formed first connector body 20 and a plug-formed second connector body 30, which are concave-convex joined in opposite directions.

The first connector body 20 includes a first connector housing 21 that is made of a synthetic resin by injection molding so as to mainly have a concave shape on the side of a top surface and have a substantially flat shape on the side of a bottom surface, a plurality of trains of male or female connection terminals, e.g. female connection terminal trains 22*a* and 22*b* that are arranged in a coplanar fashion (substantially on the same plane) in the first connector housing 21, and a ground connection fitting 23 extending between the connection terminal trains 22*a* and 22*b* in Y directions, which are train directions.

As illustrated in FIGS. 1 to 4B, the first connector housing 21 has a concave engagement portion 21*a* in the shape of, for example, a rectangular ring groove, an external surface 21*b* extending along the concave engagement portion 21*a*, a board facing surface 21*c* (refer to FIG. 3B) that faces a circuit board P (refer to FIG. 2), and a plurality of trains of terminal holders 21*h* and 21*i* arranged along the groove shape of the concave engagement portion 21*a*.

The connection terminal trains 22*a* and 22*b* include receptacle contacts that are fitted into the terminal holders 21*h* and 21*i* of the first connector housing 21, in which X directions in FIG. 1 is defined as train width directions. Each of the receptacle contacts is retained and held in the connector housing 21.

The ground connection fitting 23 is a plate-shaped conductive member that extends between the connection terminal trains 22*a* and 22*b* in join and removal directions (Z directions in FIG. 1) of the first and second connector bodies 20 and 30 and in the train directions (Y directions in FIG. 1) of the connection terminal trains 22*a* and 22*b*. The grounded ground connection fitting 23 can function as a shield member.

The ground connection fitting 23 is integrated into the first connector housing 21 by insert molding, or is press-fitted into the molded first connector housing 21.

When a ground shield plate is disposed in each of the connection terminal trains 22*a* and 22*b*, the ground shield plate in each of the connection terminal trains 22*a* and 22*b* may be connected to the ground connection fitting 23, but may be directly connected to a ground portion of the circuit board P without being connected to the ground connection fitting 23.

As illustrated in FIGS. 2 to 5B, the second connector body 30 includes a second connector housing 31 mainly having a convex shape on the side of one surface, and a plurality of trains of female or male connection terminals, e.g., male connection terminal trains 32*a* and 32*b* that are arranged in the second connector housing 31 in a coplanar fashion.

The second connector housing 31 has a convex engagement portion 31*a* in the shape of, for example, a rectangular ring projection, an external surface 31*b* (refer to FIG. 5A) extending along the convex engagement portion 31*a*, and a middle block portion 31*c* situated inside the convex engagement portion 31*a*.

The connection terminal trains 32*a* and 32*b* include plug contacts that are integrally mounted on the convex engagement portion 31*a* of the second connector housing 31. External end portions of the plug contacts are arranged in parallel with each other.

At least one connector body 20 of the first and second connector bodies 20 and 30, and also the other connector body 30 in the present embodiment, are provided with conductive reinforcement fittings 24 and 34, respectively.

As illustrated in FIGS. 1 to 4B and 6A to 6C, the first connector body 20 has the conductive first reinforcement fitting 24 provided outside the corresponding first connector housing 21. The ground connection fitting 23 has a plurality of ground connection portions 23*a* and 23*b* (refer to FIG. 3B) that are substantially in rectangular convex shapes and exposed on the side of the board facing surface 21*c* of the corresponding connector housing 21 of the first connector body 20, and reinforcement fitting connection portions 23*c* (only one side is illustrated in FIG. 1) connected to the first reinforcement fitting 24 in a partly engagement state on both outsides of the male or female connection terminal trains 22*a* and 22*b* in the train directions (Y directions).

The first reinforcement fitting 24 is made of a sheet metal into a predetermined shape by pressing. The first reinforcement fitting 24 has a pair of long side board portions 24*a* extending along the external surface 21*b* of the first connector housing 21 on both sides in the lateral directions, a pair of connection board portions 24*b* extending along the external surface 21*b* of the connector housing 21 on the outside of the concave engagement portion 21*a* of the first connector housing 21, pairs of internal and external end board portions 24*c* and 24*e* that are bent from the pair of connection board portions 24*b* so as to protrude to the side of an inner depth (downward) of the concave engagement portion 21*a*, and pairs of bent connection portions 24*d* that are joined to the pair of long side board portions 24*a* and the pair of connection board portions 24*b* at both ends and are bent in the middle.

Furthermore, the pair of reinforcement fitting connection portions 23*c* of the ground connection fitting 23 are joined to the pair of end board portions 24*c* of the first reinforcement fitting 24 by press fitting. Each end board portion 24*c* has a recessed slit-shaped opening 24*n* that contains the corresponding reinforcement fitting connection portion 23*c*, and a pair of inner projection portions 24*p* that protrude inside the opening 24*n*. The first reinforcement fitting 24 is thereby mechanically and electrically joined to the ground connection fitting 23. The connection of the first reinforcement fitting 24 to the ground portion of the circuit board P through the ground connection fitting 23 enables ground shielding.

Note that bottom end portions of the pairs of end board portions 24*c* and bottom end portions of the pairs of bent connection portions 24*d* are substantially coplanar with or protrude by a predetermined height from bottom surfaces of the connection terminal trains 22*a* and 22*b* of the connector housing 21 and bottom surfaces of the ground connection portions 23*a* and 23*b* of the ground connection fitting 23.

Figure 5A:
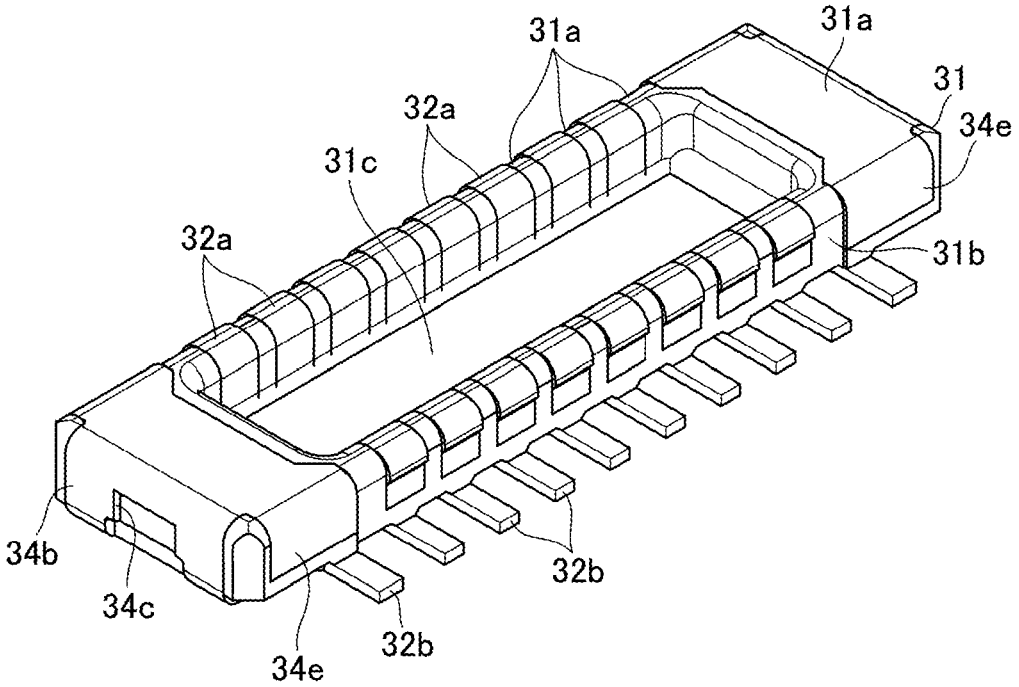
FIG. 5A is an exterior perspective view of the side of a convex-shaped bottom surface of the plug of the electric connector according to the first embodiment of the present invention.
Figure 5B:
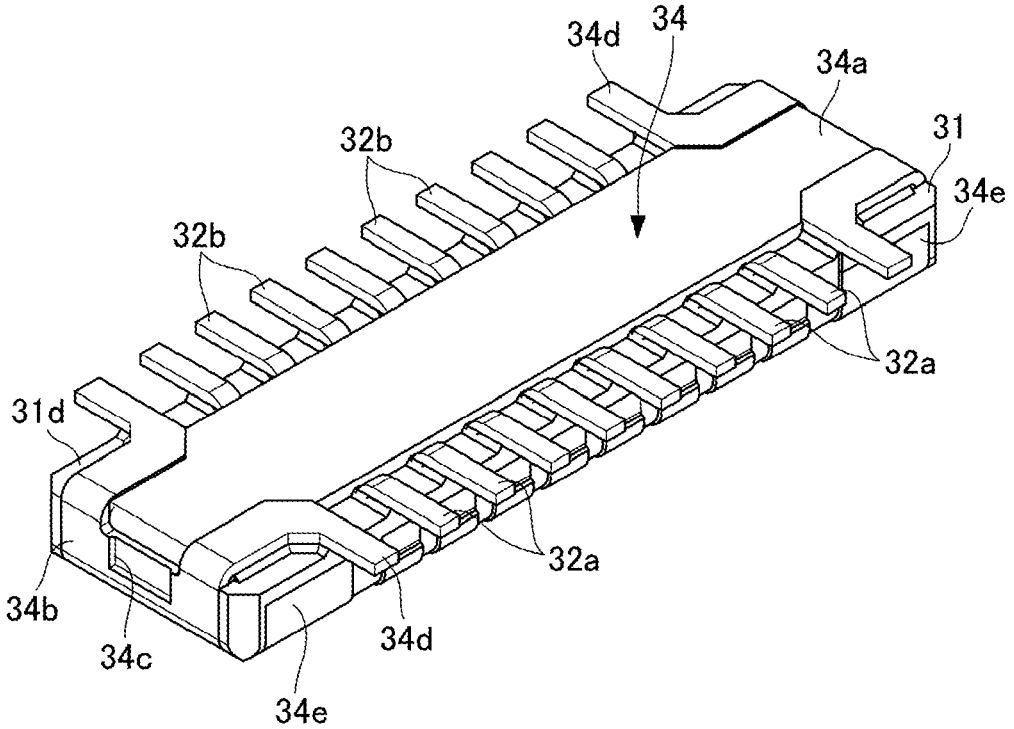
FIG. 5B is an exterior perspective view of the side of a top surface of the plug of the electric connector according to the first embodiment of the present invention.
Figure 6A:
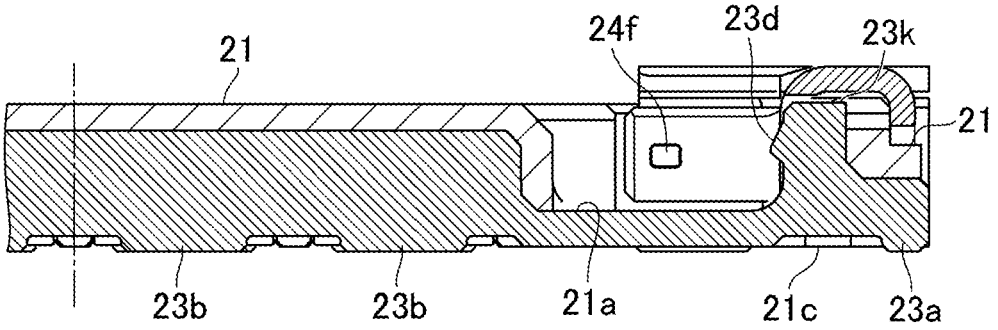
FIG. 6A is a longitudinal sectional view of a longitudinal end portion of the socket of the electric connector according to the first embodiment of the present invention.
Figure 6B:
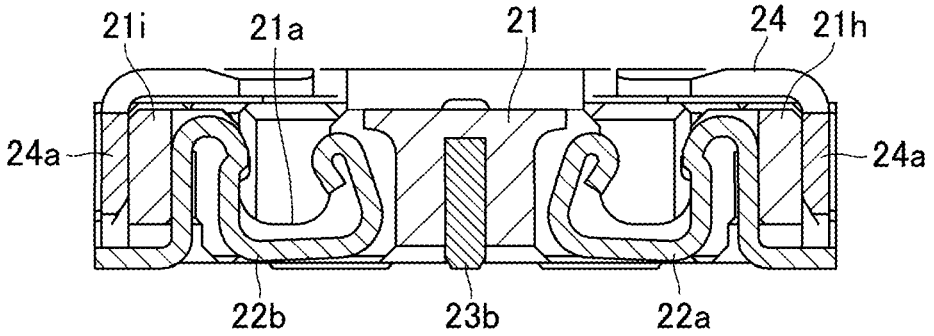
FIG. 6B is a cross sectional view illustrating a connection terminal insertion portion of the socket of the electric connector according to the first embodiment of the present invention.
Figure 6C:
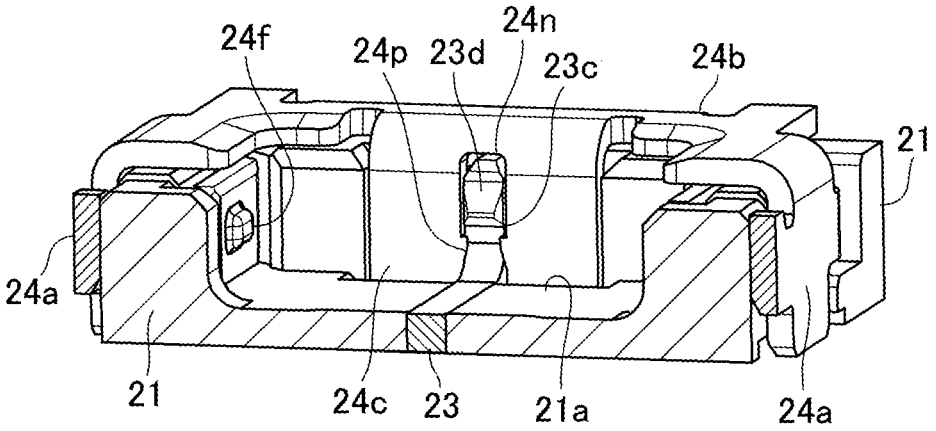
FIG. 6C is a perspective view including a cross section of the longitudinal end portion of the socket of the electric connector according to the first embodiment of the present invention.
Figure 7A:
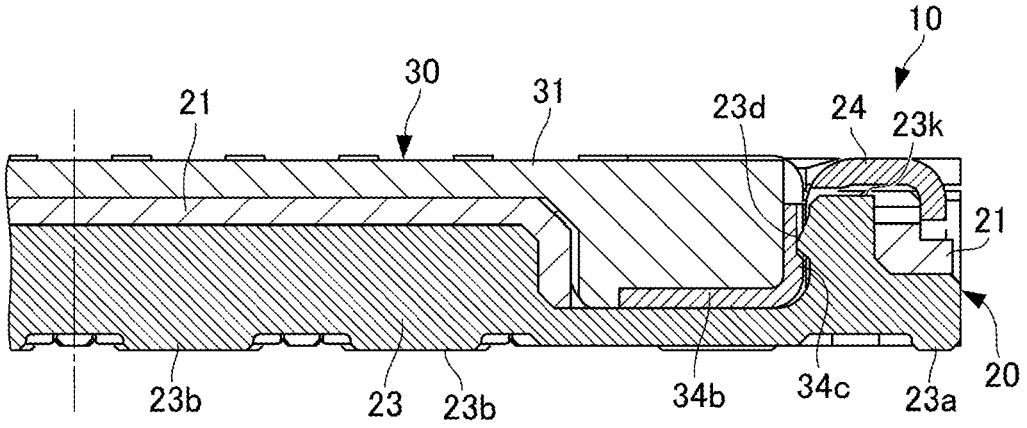
FIG. 7A is a longitudinal sectional view of a longitudinal end portion of the electric connector according to the first embodiment of the present invention in which a male and female joining state between the socket and the plug is illustrated.
Figure 7B:
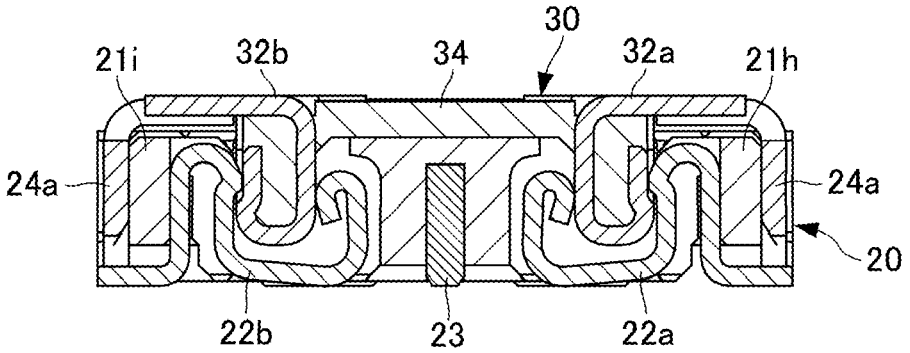
FIG. 7B is a cross sectional view illustrating a joining state of male and female connection terminals of the electric connector according to the first embodiment of the present invention in which the male and female joining state between the socket and the plug is illustrated.
Figure 7C:
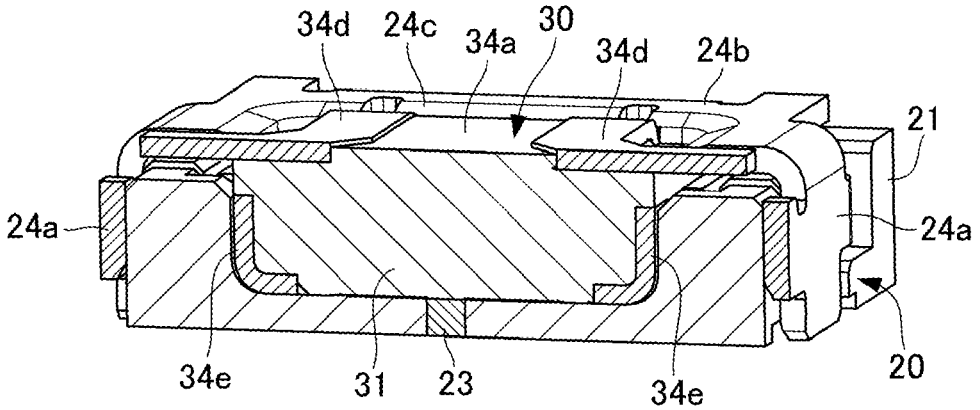
FIG. 7C is a perspective view including a cross section of the longitudinal end portion of the electric connector according to the first embodiment of the present invention in which the male and female joining state between the socket and the plug is illustrated.

As illustrated in FIGS. 5A and 5B, the second reinforcement fitting 34 provided in the second connector body 30 has a top cover 34*a* extending throughout a top surface 31*d* of the second connector housing 31 in the longitudinal directions, end board portions 34*b* that cover both end surfaces of the second connector housing 31 in the longitudinal directions and a bottom surface in the vicinity thereof, stepwise concave portions 34*c* each of which is formed in a part of the end board portion 34*b*, pairs of attachment handles 34*d* each pair of which extend from the end board portion 34*b* to the top surface of the second connector housing 31, and pairs of side board portions 34*e* that extend from both the end board portions 34*b* to both the side surfaces of the second connector housing 31.

In the bent connection portions 24*d* of the first reinforcement fitting 24, pairs of local press contact surfaces 24*f* bent substantially in the shape of projected U are formed in the vicinity of both ends of the long side board portions 24*a* of the first reinforcement fitting 24 in order to partly and elastically come into press contact with both the side board portions 34*e* of the second reinforcement fitting 34. The press contact means contact in a pressed state, and includes not only contact with elastic deformation but also contact with plastic deformation. As in the case of the reinforcement fitting 24 and the reinforcement fitting 34 according to the present embodiment, the press contact includes a combination of elastic press contact on one side and a plane receiving the contact on the other side.

A pair of the local press contact surface 24*f* and a portion of the second reinforcement fitting 34 that locally comes into press contact with each other on the outside of the male or female connection terminal train 22*a* or 22*b* in the direction of the connection terminal trains at a predetermined joint depth position (depth in an insertion direction) in directions orthogonal to the train directions of the connection terminal train 22*a* or 22*b* constitute an additional engagement holder.

The additional engagement holder has the function of defining the posture of the second connector body 30 relative to the first connector body 20 at the time of starting engagement of the male or female connection terminal trains 22*a* and 22*b* to clarify a change in operation, at the time of connecting the connector, required of engagement of the male or female connection terminal trains 22*a* and 22*b*, and the function of clarifying a click feeling at the time of connecting the connector by increasing an insertion resistance of the second connector body 30.

On the other hand, in addition that the reinforcement fitting connection portions 23*c* of the ground connection fitting 23 are mechanically and electrically joined to the end board portions 24*c* of the first reinforcement fitting 24 by press fitting, the ground connection fitting 23 is provided with a pair of reinforcement fitting connection portions 23*d* that come into engagement contact with the corresponding reinforcement fitting 34 in an engagement state with elastic deformation and elastic recovery, such as so-called snap fit, at both ends of the ground connection fitting 23. The engagement contact between the ground connection fitting 23 and the second reinforcement fitting 34 means general contact in an engagement state, and the magnitude of a contact pressure (fit strength) does not matter as long as they come into engagement contact with each other. The engagement contact includes a combination of elastic press contact on one side and a plane receiving the contact on the other side.

The reinforcement fitting connection portions 23*d* on both ends of the ground connection fitting 23 can function as retaining holders that make retaining engagement with the stepwise concave portions 34*c* of the second reinforcement fitting 34 concavely and convexly in the longitudinal directions of the connector housing 31 at predetermined joint depth positions in concave and convex joint directions of the first and second connector housings 21 and 31.

As described above, according to the present embodiment, the first reinforcement fitting connection portions 23*c* of the ground connection fitting 23 are electrically connected to the first reinforcement fitting 24, and the second reinforcement fitting connection portions 23*d* of the ground connection fitting 23 are electrically connected to the second reinforcement fitting 34 while being retained and engaged. The first and second connector bodies 20 and 30 are configured, at the time of connecting the connector bodies 20 and 30, to enable both the reinforcement fittings 24 and 34 to be ground shielded through the ground connection fitting 23. The retained engagement means an engagement state to prevent a slip out, for example, an engagement state having a projection and a depression in a direction orthogonal to attachment and detachment directions, but does not include a combination of an elastic join on one side and a planar reception of the join on the other side.

Next, the operation will be described.

In the electric connector according to the present embodiment structured as described above, the ground connection portions 23*a* and 23*b* of the ground connection fitting 23 are easily connected to the ground of the circuit board P on the side of the board facing surface 21*c* of the first connector housing 21. The reinforcement fitting connection portions 23*c* and 23*d* of the ground connection fitting 23 are exposed through the openings 24*n* to the sides of an interior wall of the concave engagement portion 21*a*, by which the first and second connector housings 21 and 31 are concave-convex engaged, from the outsides in the longitudinal directions, and are connected to the reinforcement fittings 24 and 34 at the outsides of the male or female connection terminal trains 22*a* and 22*b* in the train directions, and in the train width directions. Therefore, it is possible to improve a ground shielding effect by the ground connection fitting 23 without an increase in the size of the connector.

In the present embodiment, since the reinforcement fitting connection portions 23*c* of the ground connection fitting 23 are mechanically and electrically connected to the first reinforcement fitting 24, the first reinforcement fitting 24 situated around the connection terminal trains 22*a* and 22*b* of the first connector body 20 is ground shielded through the ground connection fitting 23, and the first reinforcement fitting 24 and the ground connection fitting 23, which are mechanically and integrally joined, are integrally held by the first connector body 20.

In particular, according to the present embodiment, since the reinforcement fitting connection portions 23*c* of the ground connection fitting 23 are in a strong engagement state by press fitting, while being contained in the openings 24*n* of the first reinforcement fitting 24, space for disposing the reinforcement fitting 24 and the reinforcement fitting connection portions 23*c* of the ground connection fitting 23 can be restrained by sharing the openings 24*n* of the reinforcement fitting 24. Since the degree of flexibility in the arrangement of the connection positions between the first reinforcement fitting 24 and the ground connection fitting 23 is increased, the second reinforcement fitting 34 can be reliably in engagement contact with and retained and joined to the first reinforcement fitting 24 in the vicinity of the concave-convex engagement portions of the first and second connector housings 21 and 31 at the outsides of the male or female connection terminal trains 22*a* and 22*b* in the train direction. Therefore, it is possible to electrically and effectively connect both the reinforcement fittings 24 and 34 to the ground connection fitting 23, while effectively restraining upsizing of the connector, thus allowing an improvement in the ground shielding effect using the ground connection fitting 23.

Furthermore, in the present embodiment, the reinforcement fittings 24 and 34 of the connector housings 21 and 31 have the local press contact surfaces 24*f* that come into press contact with each other and the like, an operation feeling such as a click feeling between the male and female connection terminal trains at the time of connecting the connector is improved by a change of an operation force required of the concave-convex engagement between the first and second reinforcement fittings 24 and 34. Since the male and female connection terminal trains 22*a*, 22*b*, 32*a* and 32*b* are come into contact with one another in a stable connection position and with a stable contact pressure, it is possible to reliably ensure a required connector connection state.

In addition, in the present embodiment, since the ground connection fitting 23 has the first reinforcement fitting connection portions 23*c* that are connected to the first reinforcement fitting 24, and the second reinforcement fitting connection portions 23*d* that are retained and engaged with the second reinforcement fitting 34, it is possible to ensure a stable connector connection state, while improving an operation feeling such as a click feeling between the male and female connection terminal trains 22*a*, 22*b*, 32*a* and 32*b* at the time of connecting the connector by a change of an operation force required of the retained engagement between the ground connection fitting 23 and the second reinforcement fitting.

Since the reinforcement fitting connection portions 23*d* of the ground connection fitting 23 constitute the retaining holders that are concave-convex engaged with the second reinforcement fitting 34 in the longitudinal directions of the second connector housing 31 at the predetermined joint depth positions in the concave-convex joint directions of the first and second connector housings 21 and 31, it is possible to allow the male and female connection terminal trains to come into contact with one another in a stable connection position and with a stable contact pressure, while improving an operation feeling such as a click feeling at the time of connecting the connector by a change of an operation force required of the concave-convex engagement between the reinforcement fittings.

Furthermore, the first reinforcement fitting 24 and the second reinforcement fitting 34 have the pairs of local press contact surfaces 24*f* and the pairs of side board portions 34*e* at the predetermined joint depth positions on the outsides in the directions of the connection terminal trains, as the additional engagement holders that come into press contact with each other in directions orthogonal to the directions of the connection terminal trains. Since the concave-convex engagement directions of the first and second reinforcement fittings 24 and 34 are the same as the engagement directions of the male and female connection terminal trains, and concave-convex engagement portions of both the reinforcement fittings 24 and 34 are situated outside the connection terminal trains in the longitudinal directions of the connector housings 21 and 31, it is possible to stabilize the engagement postures of the connection terminal trains.

As described above, according to the present embodiment, the ground connection fitting 23 between the connection terminal trains 22*a* and 22*b* can be directly connected to the ground portion of the circuit board P on the side of the board facing surface 21*c* of the first connector housing 21, and is connected to the reinforcement fittings 24 and 34 in the vicinity of concave-convex engagement surfaces of the first and second connector housings 21 and 31. Therefore it is possible to improve the ground shielding effect using the ground connection fitting 23 without an increase in the size of the connector.

Second Embodiment

Figure 8A:
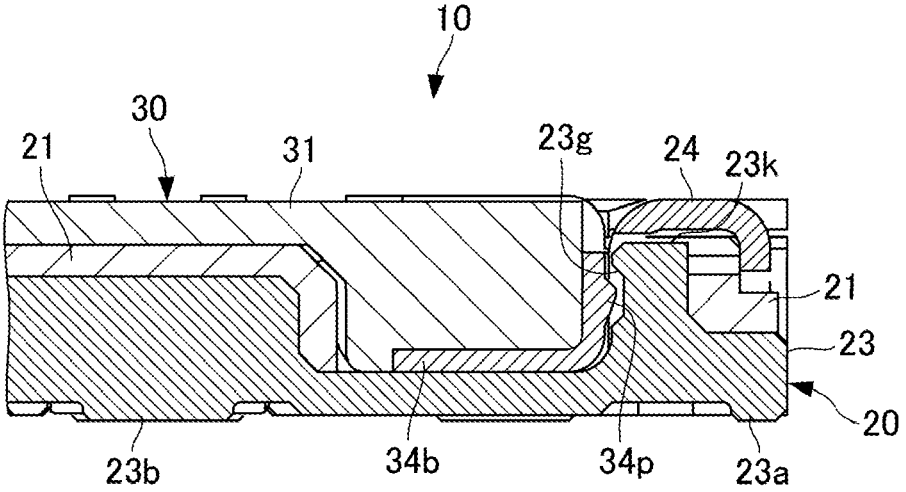
FIG. 8A is a longitudinal sectional view of a longitudinal end portion of an electric connector according to a second embodiment of the present invention in which a male and female joining state of a socket and a plug is illustrated.
Figure 8B:
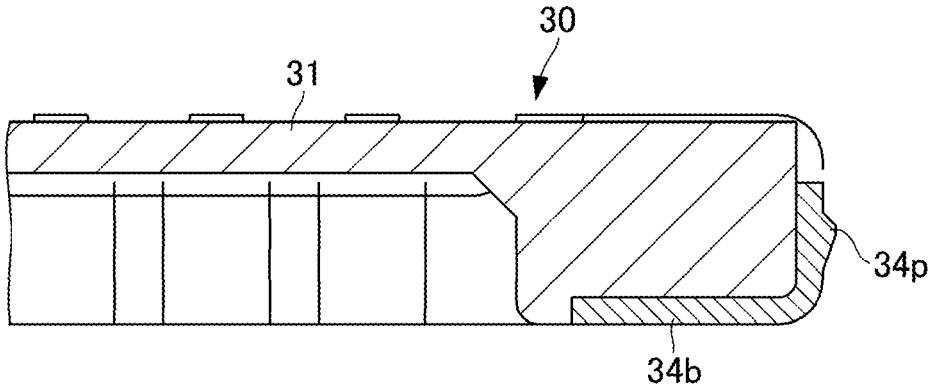
FIG. 8B is a longitudinal sectional view of the longitudinal end portion of the plug of the electric connector according to the second embodiment of the present invention.
Figure 8C:
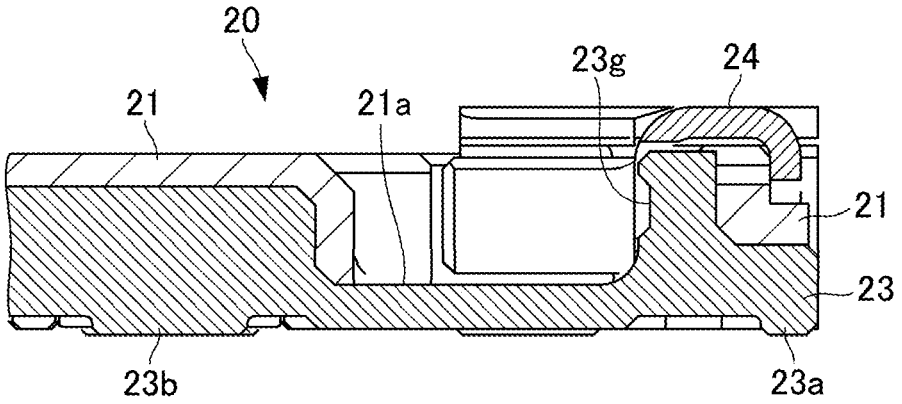
FIG. 8C is a longitudinal sectional view of the longitudinal end portion of the socket of the electric connector according to the second embodiment of the present invention.

FIGS. 8A to 8C illustrate longitudinal sections of a portion of an electric connector according to a second embodiment of the present invention. Note that, in each embodiment described below, a main structure is the same as or similar to that of the first embodiment, so that in the following description, the similar components to those I the first embodiment will be denoted by the same reference numerals and a difference from the first embodiment will be described.

As shown in FIGS. 8A to 8C, in the electric connector 10 according to the present embodiment, the ground connection fitting 23 provided in the first connector body 20 has a pair of reinforcement fitting connection portions 23*g* (first reinforcement fitting connection portions) that are concave outward in the interior wall of the concave engagement portion 21*a* in the longitudinal directions, though in the first embodiment, the pair of reinforcement fitting connection portions 23*d*, for retained engagement, of the ground connection fitting 23 provided in the first connector body 20 are in the shape of projections protruding into the concave engagement portion 21*a* so as to form lock claws that are joined to the stepwise concave portions 34*c* formed on both of the end board portions 34*b* of the second connector body 30.

On the other hand, projection portions 34*p* in the shape of lock claws that make concave-convex engagement with the pair of concave reinforcement fitting connection portions 23*g* are provided in both the end board portions 34*b* of the second connector body 30.

When the second connector body 30 is inserted into the first connector body 20, the projection portions 34*p* that protrude from both the end board portions 34*b* of the second connector body 30 are engaged by a predetermined retained engagement depth with the pair of reinforcement fitting connection portions 23*g* of the ground connection fitting 23, so as to generate a predetermined operation resistance required of a click feeling at the time of insertion and a predetermined resistance in a retaining direction.

The other configuration of this embodiment is the same as that in the aforementioned first embodiment, and thus, the same or similar effects as or to those in the aforementioned first embodiment can be obtained.

Third Embodiment

Figure 9A:
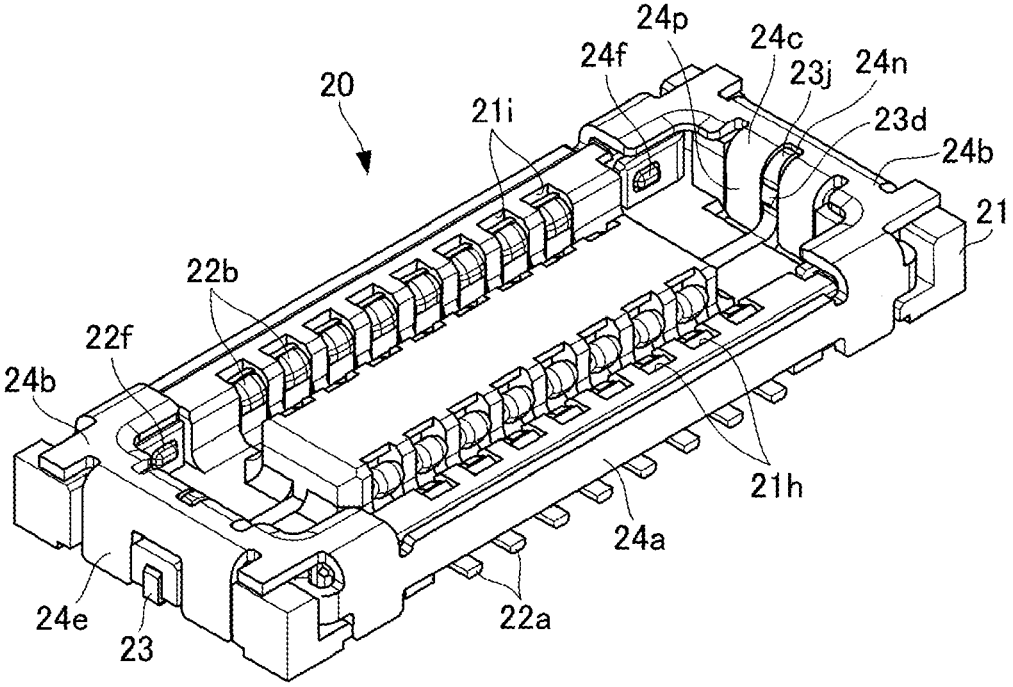
FIG. 9A is an exterior perspective view of a socket of an electric connector according to a third embodiment of the present invention.
Figure 9B:
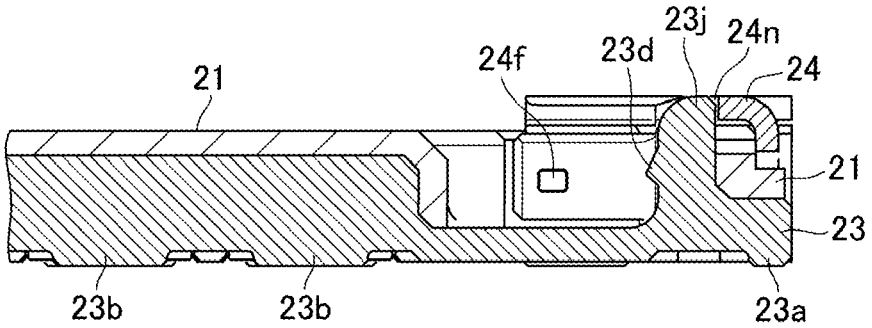
FIG. 9B is a longitudinal sectional view of a longitudinal end portion of the socket of the electric connector according to the third embodiment of the present invention.

FIGS. 9A and 9B illustrate a partial configuration of an electric connector according to a third embodiment of the present invention.

As shown in FIGS. 9A and 9B, in the first connector body 20 of the electric connector according to the present embodiment, the ground connection fitting 23 has upper connection portions 23*j* that reach the vicinities of top surfaces of the corresponding connection board portions 24*b* of the first reinforcement fitting 24, in addition to the reinforcement fitting connection portions 23*c* and 23*d* or instead of the reinforcement fitting connection portions 23*c*. To contain the pair of upper connection portions 23*j* of the ground connection fitting 23, the recessed openings 24*n* of the pair of end board portions 24*c*, which are open downward on both ends of the first reinforcement fitting 24, have an inner depth height to cut out the top surfaces of the pair of connection board portions 24*b* into opposite recesses.

The pair of upper connection portions 23*j* of the ground connection fitting 23 are contained in the recessed openings 24*n* of the pair of end board portions 24*c*. The upper connection portion 23*j* and the end board portion 24*c* are mechanically joined and electrically connected by a connection method such as ultrasonic welding. The second connector body 30 is structured in the same manner as the first embodiment.

In the present embodiment, the ground connection portions 23*a* and 23*b* of the ground connection fitting 23 are easily connected to the ground of the circuit board P on the side of the board facing surface 21*c* of the first connector housing 21. The reinforcement fitting connection portions 23*c*, 23*d* and 23*j* of the ground connection fitting 23 are exposed to the side of the interior wall of the concave engagement portion 21*a*, which makes concave-convex engagement of the first and second connector housings 21 and 31, from the outsides in the longitudinal directions, and are connected to the reinforcement fittings 24 and 34 at the outsides of the male or female connection terminal trains 22*a* and 22*b* in the train directions.

In the present embodiment, since the pair of upper connection portions 23*j* of the ground connection fitting 23 are configured to be exposed to the side of the top surfaces of the end board portions 24*c* on both ends of the first reinforcement fitting 24, the connection therebetween by ultrasonic welding or the like can be easily and reliably performed.

Therefore, as in the case of each of the embodiments described above, the present embodiment can provide the electric connector having an improved ground shielding effect using the ground connection fitting 23 without an increase in the size of the connector.

Fourth Embodiment

Figure 10:
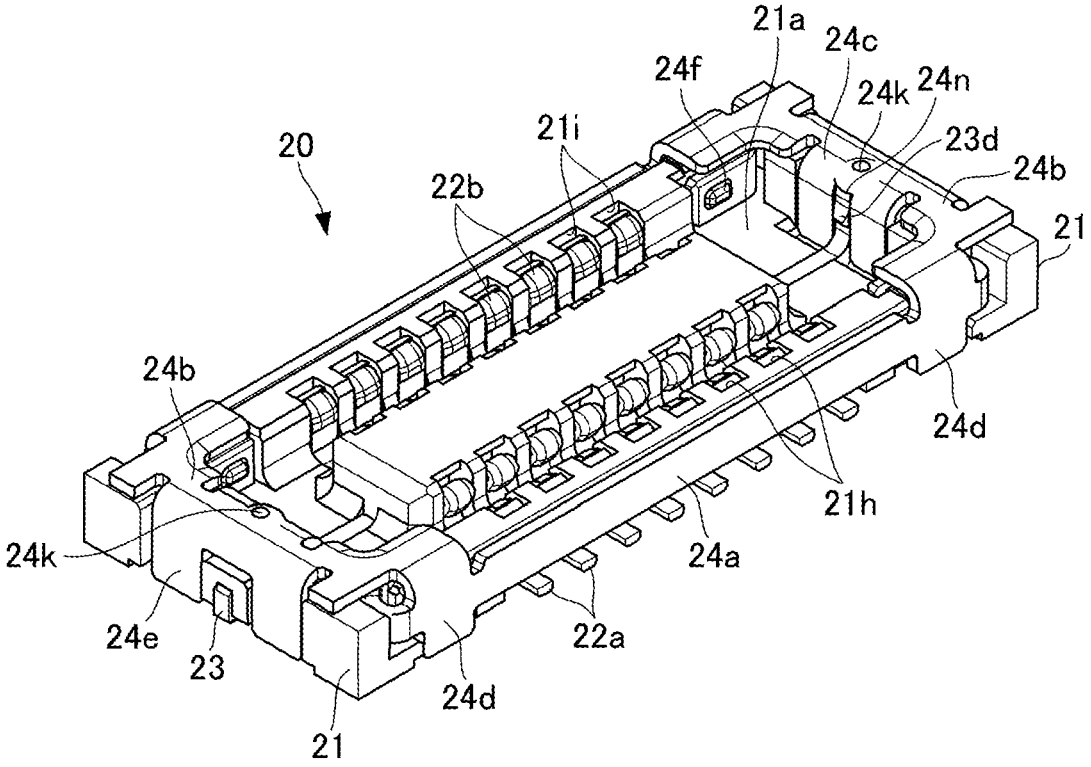
FIG. 10 is an exterior perspective view of a socket of an electric connector according to a fourth embodiment of the present invention.

FIG. 10 illustrates a partial configuration of an electric connector according to a fourth embodiment of the present invention.

As illustrated in FIG. 10, in the first connector body 20 of the electric connector according to the present embodiment, substantially in the same manner as the aforementioned first and second embodiments, the ground connection fitting 23 has upper end portions 23*k* (first reinforcement fitting connection portions; see FIGS. 6A and 8A) that are in close contact with the bottom surfaces of the corresponding connection board portions 24*b* of the first reinforcement fitting 24.

Instead of press fitting to the reinforcement fitting connection portions 23*c*, a pair of upper joint portions 24*k* that mechanically join and electrically connect the pair of upper end portions 23*k* of the ground connection fitting 23 to the pair of connection board portions 24*b* on both ends of the first reinforcement fitting 24 are provided.

Each upper joint portion 24*k* is a round cutout that is formed in the middle of each connection board portion 24*b* of the first reinforcement fitting 24. Inner circumferences of the upper joint portions 24*k* are integrally joined to the pair of upper end portions 23*k* of the ground connection fitting 23 by a connection method such as ultrasonic welding.

The other configuration of this embodiment is the same as that in the aforementioned first embodiment, and thus, the same or similar effects as or to those in the aforementioned first embodiment can be obtained.

Fifth Embodiment

Figure 11A:
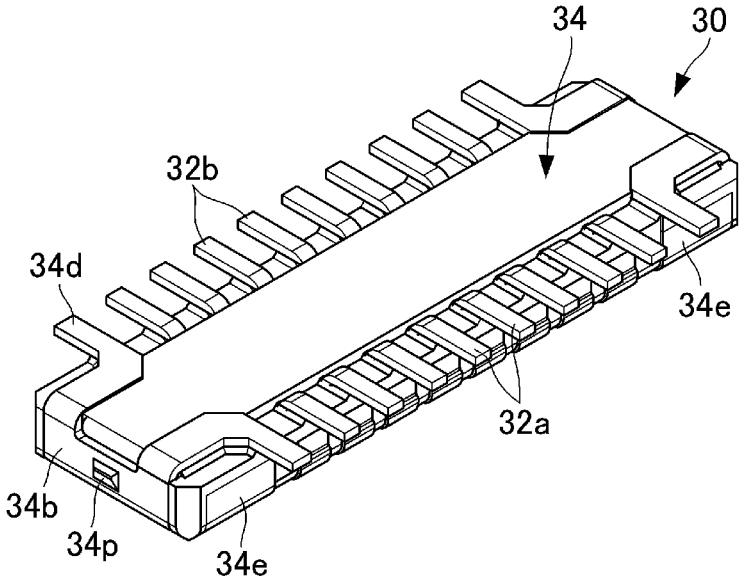
FIG. 11A is an exterior perspective view of a plug of an electric connector according to a fifth embodiment of the present invention.
Figure 11B:
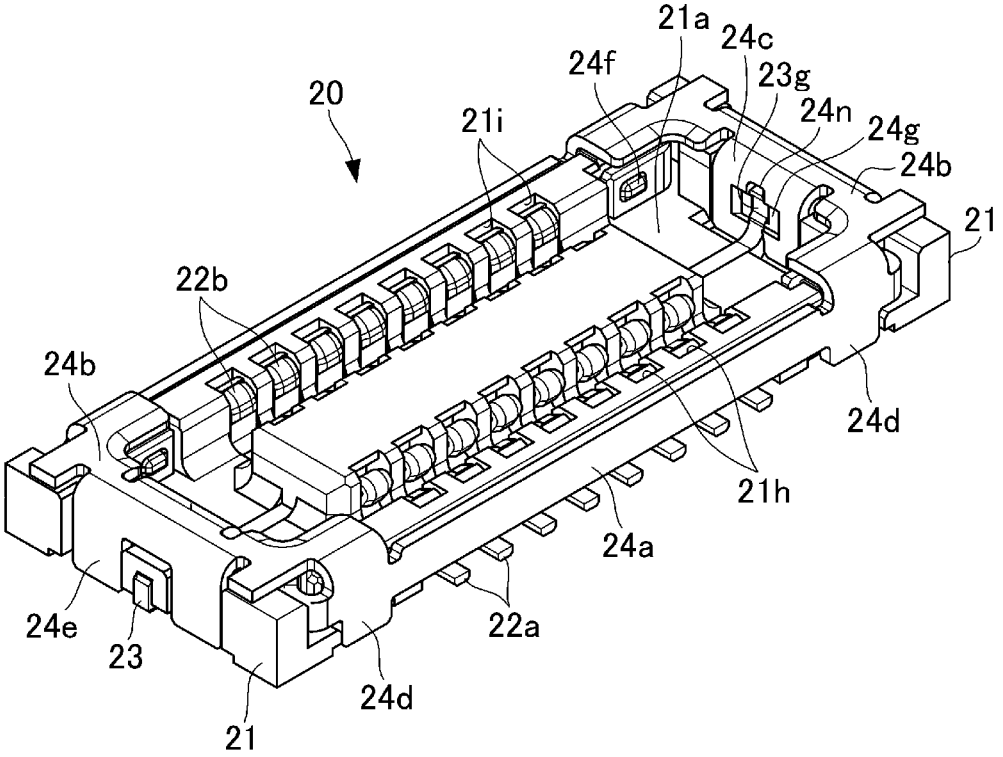
FIG. 11B is an exterior perspective view of a socket of the electric connector according to the fifth embodiment of the present invention.
Figure 11C:
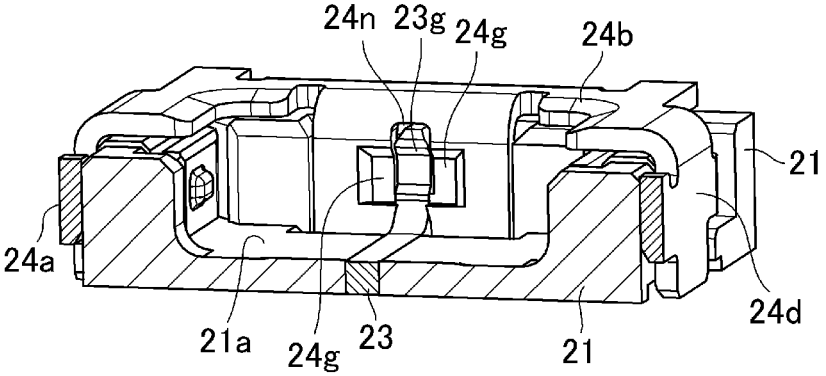
FIG. 11C is a perspective view of the socket of the electric connector according to the fifth embodiment of the present invention, including a cross section of a longitudinal end portion thereof.

FIGS. 11A to 11C illustrate a partial configuration of an electric connector according to a fifth embodiment of the present invention.

As illustrated in FIGS. 11A to 11C, in the first connector body 20 of the electric connector according to the present embodiment, the ground connection fitting 23 has a pair of concave reinforcement fitting connection portions 23*g*, and a pair of lock claw-shaped projection portions 34*p*, which make concave-convex engagement with the pair of reinforcement fitting connection portions 23*g*, are provided in both the end board portions 34*b* of the second connector body 30. The pair of lock claw-shaped projection portions 34*p* have a predetermined joint width that is larger than the plate thickness of the ground connection fitting 23 in the train width directions of the connection terminal trains 22*a* and 22*b*. In each end board portion 24*c* of the first reinforcement fitting 24, a pair of concave portions 24*g*, which contain both side ends of the corresponding projection portion 34*p* to make concave-convex engagement, are formed in an opposite manner across the opening 24*n*.

The other configuration of this embodiment is the same as that in the aforementioned first embodiment, and thus, the same or similar effects as or to those in the aforementioned first embodiment can be obtained.

Sixth Embodiment

Figure 12A:
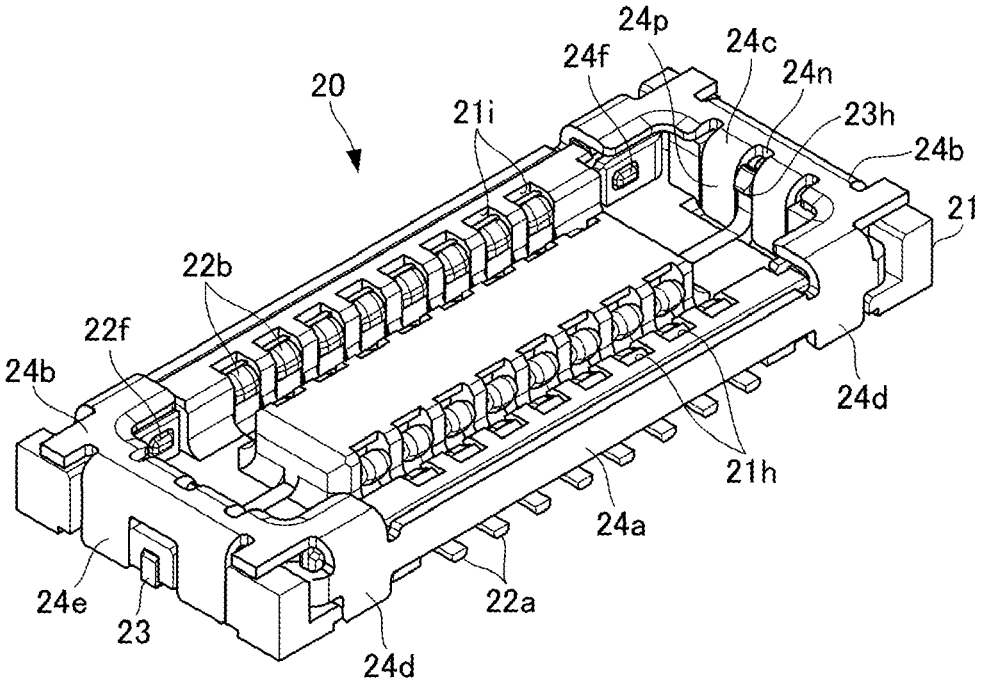
FIG. 12A is an exterior perspective view of a socket of an electric connector according to a sixth embodiment of the present invention.
Figure 12B:
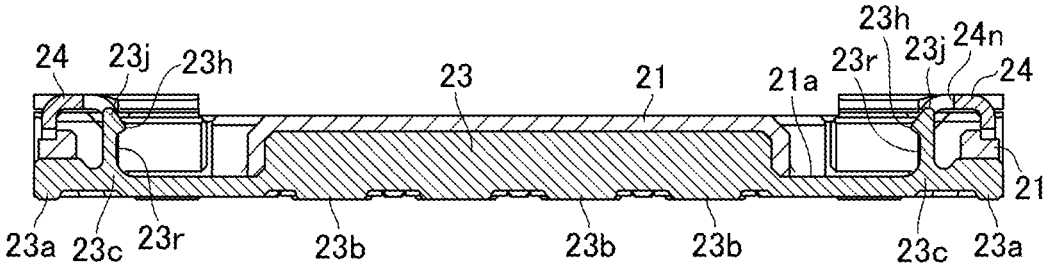
FIG. 12B is a longitudinal sectional view of the socket of the electric connector according to the sixth embodiment of the present invention.
Figure 12C:
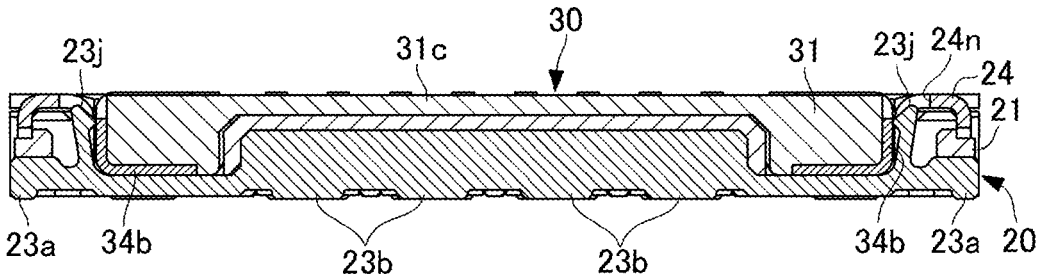
FIG. 12C is a longitudinal sectional view illustrating a male and female joining state of the socket and a plug of the electric connector according to the sixth embodiment of the present invention.

FIGS. 12A to 12C illustrate a partial configuration of an electric connector according to a third embodiment of the present invention.

As illustrated in FIGS. 12A to 12C, in the first connector body 20 of the electric connector according to the present embodiment, the ground connection fitting 23 has a pair of elastically bendable hook-shaped upper connection portions 23*j*. The pair of upper connection portions 23*j* include a pair of claw portions 23*h* (second reinforcement fitting connection portions) that are opposite to each other at a distance close to the length of the second connector body 30 apart so as to be contact joined to both the end board portions 34*b* of the second connector body 30 with a predetermined contact pressure or more, and a pair of flexible portions 23*r* that flex in directions apart from each other, when both of the end board portions 34*b* of the second connector body 30 are press opened in the direction while coming into press contact with the pair of claw portions 23*h*. In other words, aside from the reinforcement fitting connection portions 23*c* (first reinforcement fitting connection portions) of the ground connection fitting 23 that are mechanically and electrically joined to the end board portions 24*c* of the first reinforcement fitting 24 by press fitting, the pair of upper connection portions 23*j* that are in detachably engagement contact with, and in press contact with, both the end board portions 34*b* of the corresponding connector body 30 in an engagement state with elastic deformation are provided at both ends of the ground connection fitting 23.

The other configuration of this embodiment is the same as that in the aforementioned first embodiment, and thus, the same or similar effects as or to those in the aforementioned first embodiment can be obtained.

Seventh Embodiment

Figure 13:
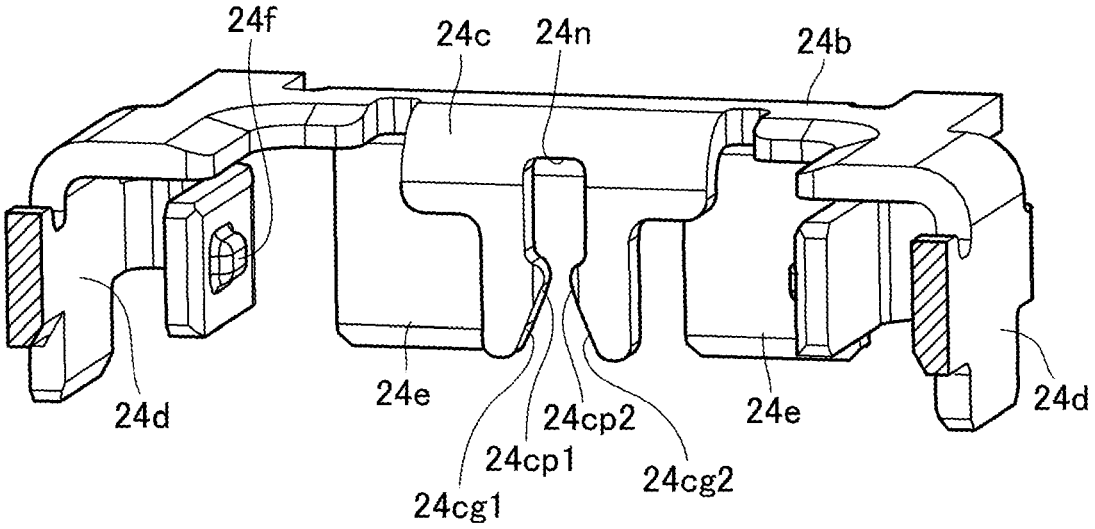
FIG. 13 is a perspective view of a portion that partly includes a cross section of a reinforcement fitting of a socket of an electric connector according to a seventh embodiment of the present invention.

FIG. 13 illustrates a partial configuration of an electric connector according to a seventh embodiment of the present invention.

As illustrated in FIG. 13, in the electric connector according to the present embodiment, the ground connection fitting 23 of the first connector body 20 is structured in the same manner as the first embodiment. On the contrary, each of the pair of end board portions 24*c*, which are bent on both ends of the first reinforcement fitting 24 so as to protrude from the pair of connection board portions 24*b* to the side of an inner depth (downward) of the concave engagement portion 21*a*, is in the form of an elastically bendable claw, and has a pair of guide portions 24*cg*1 and 24*cg*2 that guide insertion of the reinforcement fitting connection portion 23*c* of the ground connection fitting 23 and a pair of pinch protrusion portions 24*cp*1 and 24*cp*2 that are in press contact with the reinforcement fitting connection portion 23*c* of the ground connection fitting 23 from both sides in plate thickness directions. The outside end board portions 24*e*, which are bent so as to protrude from the connection board portion 24*b* to the side of the inner depth (downward) of the concave engagement portion 21*a*, extend widely on both sides of a width area of the end board portion 24*c* inside the connection terminal trains 22*a* and 22*b* in the train width directions. Therefore, the required ground shielding function due to the connection between the ground connection fitting 23 and the first reinforcement fitting 24 is assured on both ends of the first connector body 20.

The other configuration of this embodiment is the same as that in the aforementioned first embodiment, and thus, the same or similar effects as or to those in the aforementioned first embodiment can be obtained. Additionally, since the reinforcement fitting connection portions 23*c* of the ground connection fitting 23 are engaged with the pair of end board portions 24*c* of the first reinforcement fitting 24 with effective elastic deformation, it is possible to reliably ensure a contact pressure required for the electric connection therebetween.

Eighth Embodiment

FIGS. 14 and 14 illustrate a partial configuration of an electric connector according to an eighth embodiment of the present invention.

Figure 14A:
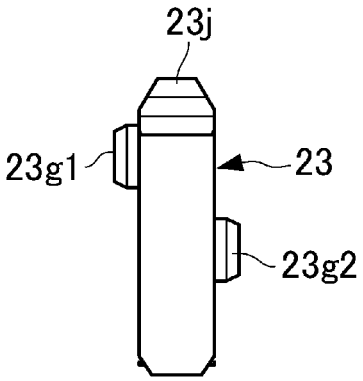
FIG. 14A is a side view of a portion of a ground connection fitting of an electric connector according to an eighth embodiment of the present invention.
Figure 14B:
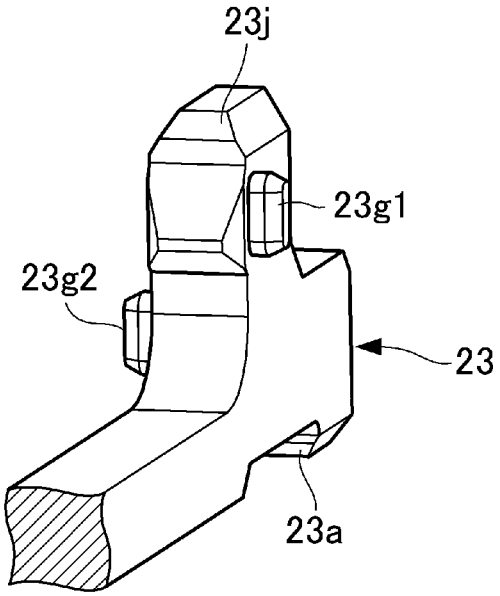
FIG. 14B is a perspective view of the portion that partly includes a cross section of the ground connection fitting of the electric connector according to the eighth embodiment of the present invention.

As illustrated in FIGS. 14A and 14B, in the electric connector according to the present embodiment, the first reinforcement fitting 24 of the first connector body 20 is structured in the same manner as the first embodiment. On the contrary, the ground connection fitting 23 has upper connection portions 23*j* that are in contact with bottom surfaces of the pair of connection board portions 24*b* at both ends of the first reinforcement fitting 24, and protrusion portions 23*g*1 and 23*g*2 that are formed on both surfaces at different positions from each other in a height direction, instead of the plate-shaped reinforcement fitting connection portions 23*c* according to the first embodiment.

Accordingly, substantially in the same manner as the aforementioned seventh embodiment, since the reinforcement fitting connection portions 23*c* of the ground connection fitting 23 are engaged with the pair of end board portions 24*c* of the first reinforcement fitting 24 with effective elastic deformation, it is possible to reliably ensure a contact pressure required for the electric connection therebetween.

The other configuration of this embodiment is the same as that in the aforementioned first embodiment, and thus, the same or similar effects as or to those in the aforementioned first embodiment can be obtained.

Note that, in each of the aforementioned embodiments, as an aspect suitable for ground shielding, the first and second connector bodies 20 and 30 are equipped with the reinforcement fittings 24 and 34, respectively. Each of the reinforcement fittings 24 and 34 is connected to the ground connection fitting 23, and both the reinforcement fittings 24 and 34 are in engagement contact with each other at a plurality of portions. However, the present invention is applicable to any electric connectors as long as they are configured such that the ground connection fitting 23 is connected to the ground portion of the circuit board P and connected to at least one of the reinforcement fittings 24 and 34. As a matter of course, either of the first and second reinforcement fittings 24 and 34 may be constituted of a plurality of parts, instead of the single frame-shaped part.

The shape of a bottom end surface of the first reinforcement fitting 24 is not described in detail, but the pairs of internal and external end board portions 24*c* and 24*e* of the first reinforcement fitting 24 may have any forms, as long as the heights of the bottom ends of the end board portions 24*c* and 24*e* are substantially in the same position as each of the ground connection portions 23*a* on the bottom of the ground connection fitting 23 at both ends, and the end board portions 24*c* and 24*e* can be connected to the same ground portion on the circuit board P. As described above, the pairs of bent connection portions 24*d* of the first reinforcement fitting 24 can have substantially the same height at their bottom ends, and can be connected to the same ground portion on the circuit board P.

In addition, although the electric connector according to each of the aforementioned embodiments has only the ground connection fitting 23 extending in the longitudinal direction of the first connector housing 21. However, in a case where the connection terminal trains 22*a* and 22*b* are arranged end to end in a plurality of lines, another ground connection fitting extending in the lateral direction of the first connector housing 21 may be additionally provided therebetween.

As a matter of course, in a case where the connection terminal trains 22*a* and 22*b* are arranged in parallel side by side in a plurality of lines, a plurality of ground connection fittings extending in parallel in the longitudinal direction of the first connector housing 21 may be provided therebetween.

As described above, the embodiments of the present invention provides the electric connector that enables the ground connection fitting 23 between the connection terminal trains to be stably connected to the ground portion of the circuit board P, and allows improvement in the ground shielding effect by provision of both the ground connection fitting and the reinforcement fittings that are ground shielded by the ground connection fitting, without an increase in the size of the connector. The present invention can be applied to general electric connectors of pseudo-coaxial structure that each have a socket mounted on a circuit board and a plug that is concave-convex engaged with the socket.

REFERENCE SIGNS LIST

10 electric connector
20 first connector body (one connector body, socket)
21 first connector housing (one connector housing)
21*a* concave engagement portion (engagement groove, concave-convex engagement portion)
21*b* external surface
21*c* board facing surface
21*h*, 21*i* terminal holder
22*a*, 22*b*, 32*a*, 32*b* connection terminal train (a plurality of connection terminals)
23 ground connection fitting
23*a*, 23*b* ground connection portion
23*c* reinforcement fitting connection portion (first reinforcement fitting connection portion)
23*d* reinforcement fitting connection portion for retained engagement (second reinforcement fitting connection portion, retaining holder)
23*g* reinforcement fitting connection portion (concave reinforcement fitting connection portion, second reinforcement fitting connection portion)
23*h* claw portion (second reinforcement fitting connection portion)
23*j* upper connection portion (first reinforcement fitting connection portion)
23*k* upper end portion (first reinforcement fitting connection portion)
24 first reinforcement fitting
24*a* long side board portion
24*b* connection board portion
24*c*, 24*e*, 34*b* end board portion
24*d* connection portion
24*f* local press contact surface (additional engagement holder)
24*g* concave portion
24*k* upper joint portion
30 second connector body (the other one connector body, plug)
31 second connector housing (the other one connector housing)
31*a* convex engagement portion (concave-convex engagement portion)
34 second reinforcement fitting
34*c* stepwise concave portion
34*e* side board portion (local press contact surface, additional engagement holder)
34*p* projection portion

The invention claimed is:

1. An electric connector comprising:

first and second connector bodies in which a plurality of connection terminal trains are arranged in a coplanar fashion in first and second connector housings that can be concave-convex joined in opposite directions; and a ground connection fitting that is equipped in the first connector body so as to extend between the plurality of connection terminal trains in a direction of the plurality of connection terminal trains of the first and second connector bodies, wherein the first connector body has a conductive first reinforcement fitting that extends along the first connector housing, and the ground connection fitting has a ground connection portion that is exposed to a side of a board facing surface of the first connector housing of the first connector body; and a plurality of reinforcement fitting connection portions that are connected to the first reinforcement fitting on both outsides of a first of the plurality of connection terminal trains in the direction of the plurality of connection terminal trains.

2. The electric connector according to claim 1, wherein the plurality of reinforcement fitting connection portions of the ground connection fitting are mechanically and electrically joined to the first reinforcement fitting.

3. The electric connector according to claim 1, further comprising:

a second conductive reinforcement fitting extending along the second connector housing, wherein the first and second conductive reinforcement fittings have local press contact surfaces that come into press contact with each other.

4. The electric connector according to claim 1, further comprising:

a second conductive reinforcement fitting extending along the second connector housing, wherein the ground connection fitting has a first of the plurality of reinforcement fitting connection portions connected to the first conductive reinforcement fitting, and a second of the plurality of reinforcement fitting connection portions that is retained and engaged with the second conductive reinforcement fitting.

5. The electric connector according to claim 2, wherein the plurality of reinforcement fitting connection portions of the ground connection fitting are mechanically and electrically joined to the first reinforcement fitting, and are contained in an opening of the first reinforcement fitting.

6. The electric connector according to claim 3, wherein the plurality of reinforcement fitting connection portions of the ground connection fitting are mechanically and electrically joined to the first reinforcement fitting extending along the first connector housing of the first connector body, and come into engagement contact with a second reinforcement fitting extending along the second connector housing of the second connector body.

7. The electric connector according to claim 6, wherein the plurality of reinforcement fitting connection portions of the ground connection fitting have a retaining holder at a predetermined joint depth position in a direction of the concave-convex joint of the first and second connector housings, to make concave-convex engagement with the second reinforcement fitting in a longitudinal direction of the second connector housing.

8. The electric connector according to claim 7, wherein the first and second reinforcement fittings have additional engagement holders outside the plurality of connection terminal trains in the direction of the plurality of connection terminal trains and at the predetermined joint depth position, to come into press contact with each other in a direction orthogonal to the direction of the plurality of connection terminal trains.

* * * * *